US011107395B2

(12) United States Patent
Chen

(10) Patent No.: US 11,107,395 B2
(45) Date of Patent: Aug. 31, 2021

(54) METHOD AND APPARATUS FOR DETECTING AMBIENT LIGHT, AND TERMINAL DEVICE AND STORAGE MEDIUM THEREOF

(71) Applicant: Beijing Xiaomi Mobile Software Co., Ltd., Beijing (CN)

(72) Inventor: Chaoxi Chen, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/806,359

(22) Filed: Mar. 2, 2020

(65) Prior Publication Data

US 2021/0125550 A1 Apr. 29, 2021

(30) Foreign Application Priority Data

Oct. 24, 2019 (CN) ..... 201911017750.9

(51) Int. Cl.
*G09G 3/3208* (2016.01)
*G09G 5/10* (2006.01)

(52) U.S. Cl.
CPC ..... *G09G 3/3208* (2013.01); *G09G 5/10* (2013.01); *G09G 2320/0626* (2013.01); *G09G 2360/144* (2013.01)

(58) Field of Classification Search
CPC ..... G09G 3/3208; G09G 3/3406; G09G 5/10; H01L 31/153
See application file for complete search history.

(56) References Cited

U.S. PATENT DOCUMENTS 10,817,018 B1 * 10/2020 Shao ..... H04N 5/3591
2008/0284716 A1 * 11/2008 Edwards ..... G09G 3/3406 345/102
2010/0060562 A1 * 3/2010 Hadwen ..... H01L 31/153 345/102
2014/0132158 A1 * 5/2014 Land ..... G09G 3/20 315/152
2015/0213781 A1 7/2015 Huang
2017/0092228 A1 * 3/2017 Cote ..... G09G 3/3225
2018/0012560 A1 * 1/2018 Yuan ..... G09G 5/10
2019/0385572 A1 * 12/2019 Zhang ..... G09G 3/3208
(Continued)

FOREIGN PATENT DOCUMENTS

CN 107818753 A 3/2018
CN 108510924 A 9/2018
(Continued)

OTHER PUBLICATIONS

International Search Report and Written Opinion of PCT Application No. PCT/CN2019/130352 dated Jul. 29, 2020.
(Continued)

*Primary Examiner* — Sardis F Azongha
(74) *Attorney, Agent, or Firm* — Finnegan, Henderson, Farabow, Garrett & Dunner, L.L.P.

(57) ABSTRACT

A method for detecting ambient light, includes: acquiring a detection signal of an ambient light sensor; acquiring a luminance level of a screen region corresponding to the ambient light sensor; and determining an intensity of the ambient light based on the detection signal of the ambient light sensor and the luminance level of the screen region corresponding to the ambient light sensor.

16 Claims, 4 Drawing Sheets

(56) References Cited

U.S. PATENT DOCUMENTS

| | | | | |
|---|---|---|---|---|
| 2020/0294468 | A1* | 9/2020 | Hung | H04B 10/516 |
| 2021/0020140 | A1* | 1/2021 | Li | G09G 5/10 |

FOREIGN PATENT DOCUMENTS

| | | | |
|---|---|---|---|
| CN | 108716950 | A | 10/2018 |
| CN | 108917921 | A | 11/2018 |
| CN | 110264978 | A | 9/2019 |
| WO | WO 2017/058421 | A1 | 4/2017 |

OTHER PUBLICATIONS

Extended European Search Report of counterpart EP Application No. 20163922.6 dated Aug. 21, 2020.

* cited by examiner

METHOD AND APPARATUS FOR DETECTING AMBIENT LIGHT, AND TERMINAL DEVICE AND STORAGE MEDIUM THEREOF

CROSS-REFERENCE TO RELATED APPLICATIONS

This application is based upon and claims priority to Chinese Application No. 201911017750.9, filed Oct. 24, 2019, the entire content of which is incorporated herein by reference.

TECHNICAL FIELD

The present disclosure relates to the field of display technologies, and in particular, relates to a method and apparatus for detecting ambient light, and a terminal device and a storage medium thereof.

BACKGROUND

As users are pursuing full screen, more and more terminal devices are being equipped with the full screen. To improve the screen-to-body ratio of a terminal device, some function elements of the terminal device are placed under the screen, for example, an ambient light sensor. The ambient light sensor is capable of sensing or perceiving an intensity of light in an environment where the terminal device is placed, and transmitting the intensity value of ambient light to a control element. The control element adjusts the screen luminance of the terminal device to give users the best visual effect.

SUMMARY

The present disclosure provides a method and apparatus for detecting ambient light, and a terminal device and a storage medium thereof, which can reduce impacts caused by screen light leakage from to an ambient light sensor, such that accuracy of an intensity of the ambient light detected by the ambient light sensor may be improved.

In a first aspect, a method for detecting ambient light includes: acquiring a detection signal of an ambient light sensor; acquiring a luminance level of a screen region corresponding to the ambient light sensor; and determining an intensity of the ambient light based on the detection signal of the ambient light sensor and the luminance level of the screen region corresponding to the ambient light sensor.

In a second aspect, an apparatus for detecting ambient light includes: a processor; and a memory storing instructions executable by the processor, wherein the processor is configured to; acquire a detection signal of an ambient light sensor; acquire a luminance level of a screen region corresponding to the ambient light sensor; and determine an intensity of the ambient light based on the detection signal of the ambient light sensor and the luminance level of the screen region corresponding to the ambient light sensor.

In a third aspect, a non-transitory computer-readable storage medium has stored thereon instructions that, when executed by a processor of a device, cause the device to perform a method for detecting ambient light, the method including: acquiring a detection signal of an ambient light sensor; acquiring a luminance level of a screen region corresponding to the ambient light sensor; and determining an intensity of the ambient light based on the detection signal of the ambient light sensor and the luminance level of the screen region corresponding to the ambient light sensor The technical solutions provided by the present disclosure achieve the following benefits:

When the intensity of the ambient light is determined by the detection signal of the ambient light sensor, the intensity of the interference light can be determined by the luminance level of the screen. In determining the intensity of the ambient light, impacts caused by the interference light can be reduced, and the intensity of the ambient light is determined. The impacts caused by the interference light are mitigated, and thus accuracy of the intensity of the detected ambient light may be improved.

It is to be understood that both the above general description and the following detailed description are exemplary and explanatory only and are not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Figure 1:
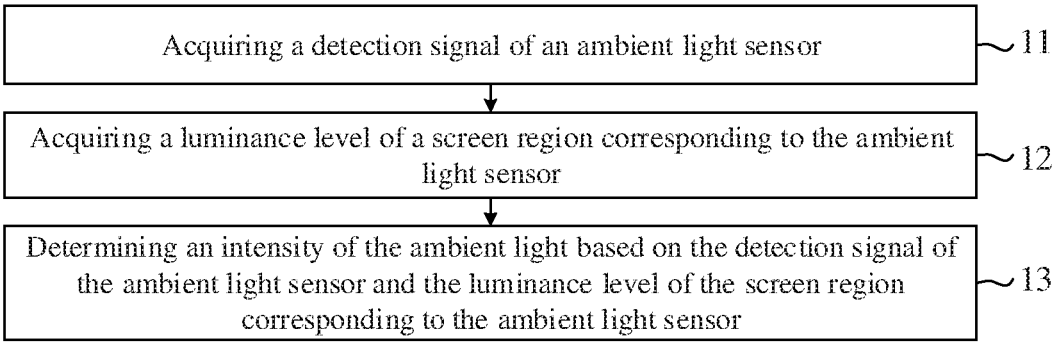
FIG. 1 is a flowchart of a method for detecting ambient light according to an embodiment of the present disclosure.

Exemplary embodiments are described in detail herein and in the accompanying drawings. Where the description refers to the accompanying drawings, unless otherwise specified, the same number in the accompanying drawings denote the same or similar elements. Implementation manners described in the following exemplary embodiments do not represent all the implementation manners consistent with the present disclosure. On the contrary, these implementation manners are merely examples illustrating apparatuses and methods according to some aspects of the present disclosure, as recited in the appended claims.

In terminal devices such as mobile phones, laptop computers or tablet computers, organic light-emitting displays (OLEDs) are extensively applied. Due to screen light transmittance of the OLED, an ambient light sensor may be arranged under the screen of the OLED, such that a screen-to-body ratio of the terminal device is improved.

The ambient light sensor may perceive surrounding light conditions, and notify, the light conditions to a processing chip in the terminal device, such that a display luminance of the screen is adjusted according to the current ambient light where the terminal device is located, and thus user experience is improved. When the luminance of the ambient light is high, the terminal device may increase the luminance of the screen. When the luminance of the ambient light is low, the terminal device may decrease the luminance of the screen to reduce power consumption thereof, such that operating time of the battery of the terminal device may be prolonged. In the meantime, adjustment of the luminance of the screen helps the display to provide a soft picture.

The ambient light sensor generally includes a photodiode array, an analog front end (AFE) circuit, a sample hold circuit and an analog-to-digital converter (ADC). The AFE circuit is connected between an output terminal of the photodiode array and the sample hold circuit, the sample hold circuit is further connected to the ADC, and a switch transistor is connected between the photodiode array and the AFE circuit, wherein the switch transistor is turned on during a detection time period of the ambient light sensor. When the switch transistor is turned on, the ambient light sensor performs integration acquisition. Exemplarily, a photocurrent generated by the photodiode array is amplified by the AFE circuit, and is supplied to a capacitor in the sample hold circuit for charging. Time for charging the capacitor is a time period in which the ambient light sensor performs a single integration acquisition. When the time for charging is reached, the switch transistor is turned off, that is, charging the capacitor is stopped. The ADC circuit starts to acquire sampled data, and corresponding ADC data (ADC count) may be acquired in the ADC circuit, which may also be referred to as a sample signal. Upon acquiring the above data, the ADC circuit may, transmit the data to a processing unit of the ambient light sensor over an inter-integrated circuit (I2C) interface. The processing unit calculates the light intensity for detection, that is, the intensity of the ambient light.

The ambient light sensor may have a plurality of channels. Different channels sense light in different wavebands. The intensity of the ambient light is obtained by calculating and integrating the light in all the wavebands. Unit conversion of the illumination (lux) corresponding to the ADC count may be carried out in the processing unit of the ambient light sensor based on the following formula:

$$Lux' = \begin{bmatrix} Lux1m \\ \vdots \\ Luxnm \end{bmatrix} = \begin{bmatrix} K11 * channel11 & \dots & K1m * channel1m \\ \vdots & \ddots & \vdots \\ Kn1 * channeln1 & \dots & Knm * channelnm \end{bmatrix} \quad (1)$$

In formula (1), channel denotes an ADC count value converted for each channel in the ambient light sensor, that is, a value of a register of the ambient light sensor; Knm (n being a positive integer) denotes a coefficient obtained by fitting; n denotes the type of a light source (light in different wavebands), that is, a fitting calculation coefficient of the light intensity in the spectrums of different light sources; and in denotes a channel serial number of the ambient light sensor. A lux equation is obtained by adding elements between corresponding row vectors in the matrix.

An attenuation gain coefficient vector obtained by spectrum fitting is as follows:

$$K = |K1 \dots Kn| \quad (2)$$

In formula (2), different Kn values (n being a positive integer) denote different spectrum attenuation gain coefficients. These coefficients are obtained and known during manufacturing of the ambient light sensor.

A finally obtained light intensity (that is, the intensity of the ambient light) is as follows:

$$Lux = Lux' * K \quad (3)$$

-continued $$= \begin{bmatrix} Lux1m \\ \vdots \\ Luxnm \end{bmatrix} * [K1 \dots Kn]$$

$$= \begin{bmatrix} K11 * channel11 & \dots & K1m * channel1m \\ \vdots & \ddots & \vdots \\ Kn1 * channeln1 & \dots & Knm * channelnm \end{bmatrix} * [K1 \dots Kn]$$

$$= \begin{bmatrix} K1 * (K11 * channel11 + \cdots \dots + K1m * channel1m) \\ \vdots \\ Kn * (Kn1 * channeln1 + \cdots \dots + Knm * channelnm) \end{bmatrix}$$

For validity of the sampled data, the sampling rate may need to be at least twice of the refreshing rate of the screen. That is, if the refreshing rate of the screen is f, and then the sampling rate needs to be at least 2f. In the meantime, the sampling time may need to be less than half of the calibrated time when the sub-pixels are turned off, because charging and discharging of the sub-pixel capacitors are not completed immediately, that is, the sub-pixels are gradually turned off from on to off, and actually the ambient light sensor is not subject to interference of the screen only within about half of the time.

When the luminance of the screen region corresponding to the ambient light sensor is high, the ambient light sensor is capable of receiving two portions of spectral energy. One portion is from screen leakage light (that is, interference light), and the other portion is from the ambient light. The screen leakage light may affect the intensity of the ambient light sensed by the ambient light sensor, and thus affect adjustment of the screen luminance of the terminal device by the control element based on the intensity of the ambient light.

The reasons why the screen causes greater interference to the ambient light sensor when the luminance level of the screen is high are described hereinafter.

In a terminal device, on and off of a sub-pixel are controlled by on and off of a light-emitting diode (LED), and on and off of the LED are controlled by a switch of a metal-oxide-semiconductor field-effect transistor (MOSFET). That is, the switch of the MOSFET may control on and off of the sub-pixel.

The light-emitting luminance and time of the LED may be controlled by controlling the MOSFET, such that the luminances of the corresponding sub-pixels in a frame of picture are controlled.

In the related art, the control modes of the sub-pixel include: pulse width modulation (PWM), pulse frequency modulation (PFM), and pulse amplitude modulation (PAM).

The PWM controls the light-emitting time of the LED by controlling the time during which the MOSFET is on, and hence controls the luminance of the sub-pixel. When the luminance of the sub-pixel is high, the time when the MOSFET is on is controlled to be longer.

The PFM controls the luminance of the LED by controlling a conversion frequency of the MOSFET between on and off, and hence controls the luminance of the sub-pixel. When the luminance of the sub-pixel is high, the time when the MOSFET is on is controlled to be longer.

The PAM controls the amplitude of a current flowing into the LED by controlling a control voltage of the MOSFET, and hence controls the luminance of the sub-pixel. When the luminance of the sub-pixel is high, the control voltage of the MOSFET is controlled to be greater.

For the PWM and the PFM, when the luminance level of the sub-pixel is high, the time during which the sub-pixel is on is long and the time during which the sub-pixel is off is short, and the ambient light sensor needs to perform a detection within the time during which the sub-pixel is off. However, since the time during which the sub-pixel is off is short and less than the time of a single detection performed by the ambient light sensor, when the luminance level of the sub-pixel is high, the detection time of the ambient light sensor may overlap the time during which the sub-pixel is on, that is, the ambient light sensor may detect the interference light.

For the PAM, when the luminance level of the sub-pixel is high, the control voltage of the MOSFET is great, that is, the voltage for charging a capacitor in the sub-pixel is high, and the discharging time elapsed when the sub-pixel is turned off is long. As a result, the time during which the sub-pixel is off is short, and likewise, the ambient light sensor may detect the interference light.

FIG. 1 is a flowchart of a method for detecting ambient light according to an embodiment of the present disclosure. Referring to FIG. 1, the method for detecting ambient light may include the following steps.

In step 11, a detection signal of an ambient light sensor is acquired.

The method may be performed by such a terminal device as a mobile phone, a laptop computer or a tablet computer. The terminal device may acquire a detection signal of an ambient light sensor arranged therein, and determine an intensity of ambient light based on the detection signal.

In step 12, a luminance level of a screen region corresponding to the ambient light sensor is acquired.

The luminance level of the screen region is correlated to an intensity of interference light generated by the screen to the ambient light sensor.

In the embodiment, the screen region corresponding to the ambient light sensor includes an orthographic projection of the ambient light sensor on the screen. The orthographic projection of the ambient light sensor on the screen may coincide with the screen region, or the orthographic projection of the ambient light sensor on the screen overlaps with and located in the screen region.

The luminance level is used for indicating the luminance of the screen region corresponding to the ambient light sensor. The luminance level may be a sum of the luminance level of each sub-pixel in the screen region, and the luminance level of each sub-pixel may be a grayscale level of the sub-pixel.

For example, the screen region corresponding to the ambient light sensor includes t sub-pixels. Each sub-pixel includes sub-pixels of three colors red, green and blue (RGB). Each sub-pixel has 256 luminance levels. In this case, each sub-pixel has $2^{24}$ luminance levels, and hence the t sub-pixels have $2^{24t}$ luminance levels. That is, the luminance level of the screen region corresponding to the ambient light sensor is a sum of the luminance levels of the t sub-pixels, and totally $2^{24t}$ possible options may be present.

The luminance of the screen of the terminal device may be determined based on the luminance level of the screen region corresponding to the ambient light sensor. For example, when the ambient light sensor detects that the luminance level of the screen region corresponding to the ambient light sensor is less than a threshold, it is determined that the luminance of the screen of the terminal device is low; and when the ambient light sensor detects that the luminance level of the screen region corresponding to the ambient light sensor is greater than or equal to the threshold, it is determined that the luminance of the screen of the terminal device is high.

In step 13, an intensity of the ambient light is determined based on the detection signal of the ambient light sensor and the luminance level of the screen region corresponding to the ambient light sensor.

In the embodiment of the present disclosure, when the intensity of the ambient light is determined by the detection signal of the ambient light sensor, the intensity of the interference light can be determined by the luminance level of the screen. In determining the intensity of the ambient light, impacts caused by the interference light can be reduced, and finally the intensity of the ambient light is determined. The impacts caused by the interference light are mitigated, and thus the intensity of the detected ambient light is more accurate.

The intensity of the ambient light is detected by the above method, and then the luminance of the display screen is adjusted based on the intensity of the ambient light. In this way, the accuracy of adjusting the luminance of the display screen by the processing chip can be improved.

In an embodiment, acquiring the luminance level of the screen region corresponding to the ambient light sensor includes: acquiring a luminance level of each sub-pixel in the screen region corresponding to the ambient light sensor; and determining a sum of the luminance levels of all the sub-pixels in the screen region corresponding to the ambient light sensor as the luminance level of the screen region corresponding to the ambient light sensor.

In this embodiment, the sum of the luminance levels of all the sub-pixels in the screen region corresponding to the ambient light sensor is determined as the luminance level of the screen region corresponding to the ambient light sensor, such that the luminance level of the screen region corresponding to the ambient light sensor is conveniently determined.

As described above, the luminance level of the sub-pixel may be the grayscale level of the sub-pixel. Therefore, the luminance level of each sub-pixel can be determined based on a grayscale control signal in the terminal device.

In an embodiment, determining the intensity of the ambient light based on the detection signal of the ambient light sensor and the luminance level of the screen region corresponding to the ambient light sensor includes: when the luminance level is less than a threshold, determining the intensity of the ambient light based on the detection signal of the ambient light sensor.

In an embodiment, determining the intensity of the ambient light based on the detection signal of the ambient light sensor and the luminance level of the screen region corresponding to the ambient light sensor includes: when the luminance level is greater than or equal to a threshold, determining an interference signal based on the detection signal of the ambient light sensor, and determining the intensity of the ambient light based on the detection signal of the ambient light sensor and the interference signal.

In the embodiments, when the luminance level of the screen region corresponding to the ambient light sensor is low, the interference caused by the screen to the ambient light sensor is small. In this case, the intensity of the ambient light can be directly determined based on the detection signal of the ambient light sensor. When the luminance level of the screen region corresponding to the ambient light sensor is high, the interference caused by the screen to the ambient light sensor is great. In this case, the signal detected by the ambient light sensor includes the interference light, and the intensity of the ambient light can be determined after the interference light is removed. By reducing the impacts caused by the interference light, the accuracy of the ambient light detection can be improved.

In an embodiment, determining the interference signal based on the detection signal of the ambient light sensor includes: sampling the detection signal of the ambient light sensor to obtain a sampling signal; performing Fourier transform for the sampling signal to obtain a first transformation value; and determining the interference signal corresponding to the first transformation value based on a relation between the transformation value and the interference signal.

In this embodiment, a plurality of sampling signals are acquired, and the Fourier transform is performed. A result of the Fourier transform includes a direct-current component and an alternating-current component, wherein the alternating-current component is also the first transformation value mentioned above, and the first transformation value is the information of the interference light generated by the screen. The interference signal corresponding to the interference light is determined by using the first transformation value, such that preparations are made for reducing the impacts caused by the interference light subsequently. This method can accurately determine the interference signal, such that the accuracy of determining the intensity of the ambient light subsequently is higher.

For example, assuming that the sampling is performed by a frequency of 2f, then the sampling signals may include 2f sampling signals. A 2f Hz Fourier transform is performed for a bit string formed by the 2f sampling signal to obtain the first transformation value.

In an embodiment, determining the intensity of the ambient light based on the detection signal of the ambient light sensor and the interference signal includes: subtracting the interference signal from the sampling signal to obtain a correction signal; and calculating the intensity of the ambient light corresponding to the correction signal.

In this embodiment, the correction signal is determined by the interference signal, and then the intensity of the ambient light is determined based on the correction signal. In this way, the impacts caused by the interference light are reduced, and the detection accuracy of the ambient light is ensured.

In an embodiment, the method for detecting ambient light further includes: acquiring a plurality of detection signals of the ambient light sensor when the screen displays different luminances in a dark environment; sampling the plurality of detection signals respectively to obtain a plurality of interference signals; performing Fourier transform for the plurality of interference signals respectively to obtain a plurality of transformation values; and fitting a relation curve by taking each of the transformation values and the corresponding interference signal as a sampling point to obtain a relation between the transformation value and the interference signal.

In this embodiment, the signals detected by the ambient light sensor in the dark environment are all interference light signals, and no ambient light signal is detected. A plurality of groups of transformation values and interference signals can be obtained by adjusting the screen to display different luminances, and a function relationship between the transformation value and the interference signal can be obtained by function fitting. That is, in the subsequent ambient light detection, the interference signal of the specific interference light can be determined according to the fitted function relationship between the transformation value and the interference signal.

In the embodiment, the interference signal and the sample signal are both a sample signal string, that is, a string of binary data.

It should be noted that steps 11 to 13 may be randomly combined with the above described operations.

Figure 2:
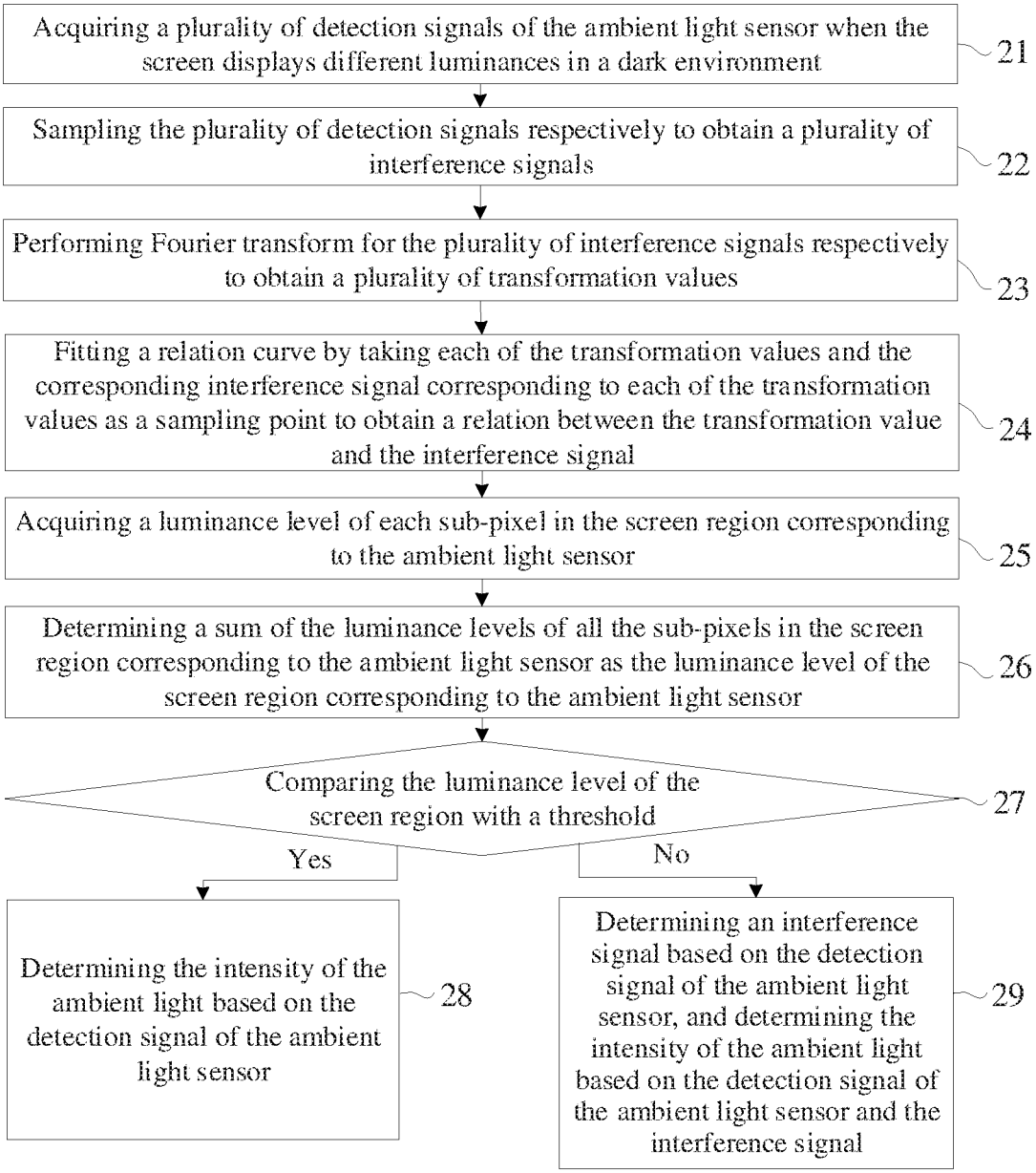
FIG. 2 is a flowchart of a method for detecting ambient light according to an embodiment of the present disclosure.

FIG. 2 is a flowchart of a method for detecting ambient light according to an embodiment of the present disclosure. Referring to FIG. 2, the method for detecting ambient light may include the following steps.

In step 21, a plurality of detection signals of the ambient light sensor when the screen displays different luminances in a dark environment are acquired.

The signals detected in the dark environment are all interference light signals, and no ambient light signal is detected Exemplarily, the screen region corresponding to the ambient light sensor includes 12 sub-pixels, and as described above, the luminance level of t sub-pixels is $2^{24t}$, and totally $2^{24}\times12$ options are present for the luminance level of the screen region corresponding to the ambient light sensor. In this case, several (for example, 100) luminance levels are chosen for test, and the detection signals of the ambient light sensor under these different luminance levels in a dark environment are acquired. For ease of the test, the screen can be controlled to display a monochromic picture, which is convenient to the control of the displayed picture and to calculate the luminance level of the screen region, as long as the sum of the luminance levels of the sub-pixels in a single pixel is multiplied by the number of sub-pixels.

In step 22, the plurality of detection signals are sampled respectively to obtain a plurality of interference signals.

For example, a detection signal is sampled by using 2f as a frequency to obtain 2f sampled values. These 2f sampled values form the interference signal. When the above 100 luminance levels are chosen for test, 100 interference signals may be obtained.

In step 23, Fourier transform is performed for the plurality of interference signals respectively to obtain a plurality of transformation values.

The interference signal is transformed to a transformation value by the Fourier transform. In this case, the result of the Fourier transform does not include a direct-current component, but only includes an alternating-current component. The alternating-current component is extracted by the Fourier transform, the impacts caused by the interference light can be reduced in subsequent calculation of the intensity of the ambient light, such that the accuracy of determining the intensity of the ambient light subsequently is higher.

For example, the Fourier transform is performed for the above 100 interference signals, 100 transformation values may be obtained.

In an embodiment, the Fourier transform may be fast Fourier transform (FFT), which accelerates the calculation.

In step 24, a relation curve is fit by taking each of the transformation values and the corresponding interference signal as a sampling point to obtain a relation between the transformation value and the interference signal.

In step 21, the detection signals under a plurality of luminance levels can be acquired respectively to obtain a plurality of pairs of the interference signal and transformation value. By taking each pair of transformation value and interference signal as a sampling point, the function relationship between the transformation value and the interference signal (that is, the sampling signal) can be obtained by fitting.

The ambient light sensor includes in channels, wherein each of the in channels is separately sampled and fitted. That is, the function relationship between in transformation values and the interference signals is obtained by fitting the m channels. In subsequent calculation, the interference signal of each channel is calculated separately.

For example, there totally has $2^{24t}$ luminance levels (t is the number of sub-pixels in the screen region corresponding to the ambient light sensor) in the screen region corresponding to the ambient light sensor, and some samples therein are chosen for calculation to obtain the function relationship between the transformation values and the interference signals. The calculation process may be an iterative solution for the function relationship by using an iteration rule. Exemplarily, the iteration rule specifies that the fitted function relationship causes root mean square error between the transformation value and the interference signal predicted by a function model solved to be minimized.

Step 21 to step 24 may be completed before delivery of the terminal device from factory, and then the relationship between the transformation value and the interference signal is stored in the terminal device or the ambient light sensor, and may be directly acquired when subsequent use.

In step 25, a luminance level of each sub-pixel in the screen region corresponding to the ambient light sensor is acquired.

For example, the screen region corresponding to the ambient light sensor includes 12 sub-pixels, and then the ambient light sensor may acquire the luminance levels of the 12 sub-pixels.

In step 26, a sum of the luminance levels of all the sub-pixels in the screen region corresponding to the ambient light sensor is determined as the luminance level of the screen region corresponding to the ambient light sensor.

For example, the luminance levels of the 12 sub-pixels acquired above are added to obtain the luminance level of the screen region corresponding to the ambient light sensor.

In step 27, the luminance level of the screen region is compared with a threshold.

The threshold herein may be predefined according to the actual needs.

During the process of displaying a frame by the sub-pixels, generally a charging stage, a retaining stage, a discharging stage and a non-charging and non-discharging stage are included. At the retaining stage and the discharging stage, the sub-pixels emit light; and at the non-charging and non-discharging stage and the charging stage, the sub-pixels do not emit light. The sampling time of the ambient light sensor generally corresponds to the time during which the sub-pixels do not emit light. However, when the same sub-pixel displays different luminance levels, the higher the luminance level, the longer the discharging time, and the shorter the time during which the sub-pixel does not emit light. When the time during which the sub-pixels do not emit light is less than the sampling time, sampling by the ambient light sensor is subject to the interference caused by light emitting of the screen. The stages listed herein are only examples, and in practice, more or fewer stages may be included.

Based on the above information, the threshold may be determined as follows: non-charging time of a sub-pixel (for example, a red, green or blue pixel) in the screen under each luminance level is acquired, that is, a time length except the charging stage; and since the time of a frame and the charging time under each luminance level are determined, the non-charging time under each luminance level is determined. A non-charging time, a difference between ½ of which and the sampling time of the ambient light sensor is the minimum, is chosen from the non-charging time corresponding to all the luminance levels. The luminance level corresponding to the chosen non-charging time is multiplied by the number of sub-pixels in the screen region as the aforementioned threshold.

The ½ of the non-charging time herein is used as a reference since the ambient light sensor is not subject to the interference from the screen only within about half of the non-charging time. When the difference between the ½ of the non-charging time and the sampling time of the ambient light sensor is the minimum, the luminance level corresponding to the non-charging time may rightly ensure sampling by the ambient light sensor. If a luminance level is greater than the luminance level corresponding to the non-charging time, sampling of the ambient light sensor is subject to the interference, and on the contrary, sampling of the ambient light sensor is not subject to the interference.

In step 28, when the luminance level is less than a threshold, the intensity of the ambient light is determined based on the detection signal of the ambient light sensor.

For example, when the detected luminance level is less than the threshold, the intensity of the ambient light is calculated by the above formula (3).

In step 29, when the luminance level is greater than or equal to a threshold, an interference signal is determined based on the detection signal of the ambient light sensor, and the intensity of the ambient light is determined based on the detection signal of the ambient light sensor and the interference signal.

For example, when the luminance level is greater than or equal to the threshold, the impacts caused by the interference light need to be reduced, and the interference signal under this luminance level is determined according to the luminance level and the function relationship obtained in step 21 to step 24, to reduce the impacts caused by the interference light.

In an embodiment, determining the interference signal based on the detection signal of the ambient light sensor includes: sampling the detection signal of the ambient light sensor to obtain a sampling signal; performing Fourier transform for the sampling signal to obtain a first transformation value; and determining the interference signal corresponding to the first transformation value based on a relation between the transformation value and the interference signal.

In this embodiment, a plurality of sampling signals are acquired, and Fourier transform is performed. A result of the Fourier transform includes a direct-current component and an alternating-current component, wherein the alternating-current component is also the first transformation value mentioned above, and the first transformation value is the information of the interference light generated by the screen. The interference signal corresponding to the interference light is determined by using the first transformation value, such that preparations are made for reducing the impacts caused by the interference light subsequently.

In an embodiment, determining the intensity of the ambient light based on the detection signal of the ambient light sensor and the interference signal includes: subtracting the interference signal from the sampling signal to obtain a correction signal; and calculating the intensity of the ambient light corresponding to the correction signal.

In this embodiment, the interference signal is subtracted from a total integration value detected by the ambient light sensor to obtain the correction signal. The correction signal herein and the detection signal are both directed to the same channel in the ambient light sensor. In practical calculation, the detection signal of each channel needs to be corrected, and the correction signal is substituted into the above formula (3) to obtain the intensity of the ambient light.

Figure 3:
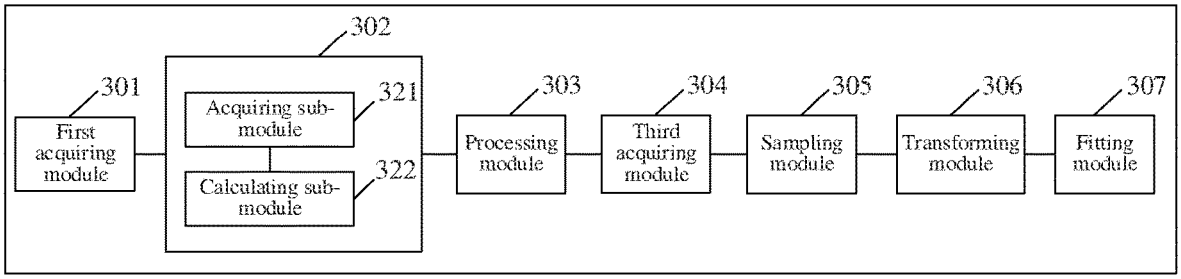
FIG. 3 is a block diagram of an apparatus detecting ambient light according to an embodiment of the present disclosure.

FIG. 3 is a block diagram of an apparatus for detecting ambient light according to an embodiment of the present disclosure. Referring to FIG. 3, the apparatus includes: a first acquiring module 301, a second acquiring module 302, and a processing module 303.

The first acquiring module 301 is configured to acquire a detection signal of an ambient light sensor. The second acquiring module 302 is configured to acquire a luminance level of a screen region corresponding to the ambient light sensor. The processing module 303 is configured to determine an intensity of the ambient light based on the detection signal of the ambient light sensor and the luminance level of the screen region corresponding to the ambient light sensor.

The first acquiring module 301 acquires the detection signal of the ambient light sensor; the second acquiring module 302 acquires the luminance level of the screen region corresponding to the ambient light sensor, wherein the luminance level of the screen region corresponding to the ambient light sensor is correlated to the intensity of the interference light; and the processing module 303 determines the intensity of the ambient light according to the detection signal of the ambient light sensor and the luminance level of the screen region corresponding to the ambient light sensor. In this way, the impacts caused by the interference light are mitigated, the intensity of the ambient light is finally determined, and thus the detection result is more accurate.

Still referring to FIG. 3, the second acquiring module 302 includes: an acquiring sub-module 321 and a calculating sub-module 322.

The acquiring sub-module 321 is configured to acquire a luminance level of each sub-pixel in the screen region corresponding to the ambient light sensor. The calculating sub-module 322 is configured to determine a sum of the luminance levels of all the sub-pixels in the screen region corresponding to the ambient light sensor as the luminance level of the screen region corresponding to the ambient light sensor.

In an embodiment, the processing module 303 is configured to, when the luminance level is less than a threshold, determine the intensity of the ambient light based on the detection signal of the ambient light sensor. In an embodiment, the processing module 303 is configured to, when the luminance level is greater than or equal to a threshold, determine an interference signal based on the detection signal of the ambient light sensor, and determine the intensity of the ambient light based on the detection signal of the ambient light sensor and the interference signal.

In an embodiment, the processing module 303 is further configured to: sample the detection signal of the ambient light sensor to obtain a sampling signal; perform Fourier transform for the sampling signal to obtain a first transformation value; and determine the interference signal corresponding to the first transformation value based on a relation between the transformation value and the interference signal.

In an embodiment, the processing module 303 is further configured to subtract the interference signal from the sampling signal to obtain a correction signal, and calculate the intensity of the ambient light corresponding to the correction signal.

Still referring to FIG. 3, the apparatus further includes: a third acquiring module 304, a sampling module 305, a transforming module 306 and a fitting module 307.

The third acquiring module 304 is configured to acquire a plurality of detection signals of the ambient light sensor when the screen displays different luminances in a dark environment. The sampling module 305 is configured to sample the plurality of detection signals respectively to obtain a plurality of interference signals. The transforming module 306 is configured to perform Fourier transform for the plurality of interference signals respectively to obtain a plurality of transformation values. The fitting module 307 is configured to fit a relation curve by taking each of the transformation values and the corresponding interference signal as a sampling point to obtain a relation between the transformation value and the interference signal.

Figure 4:
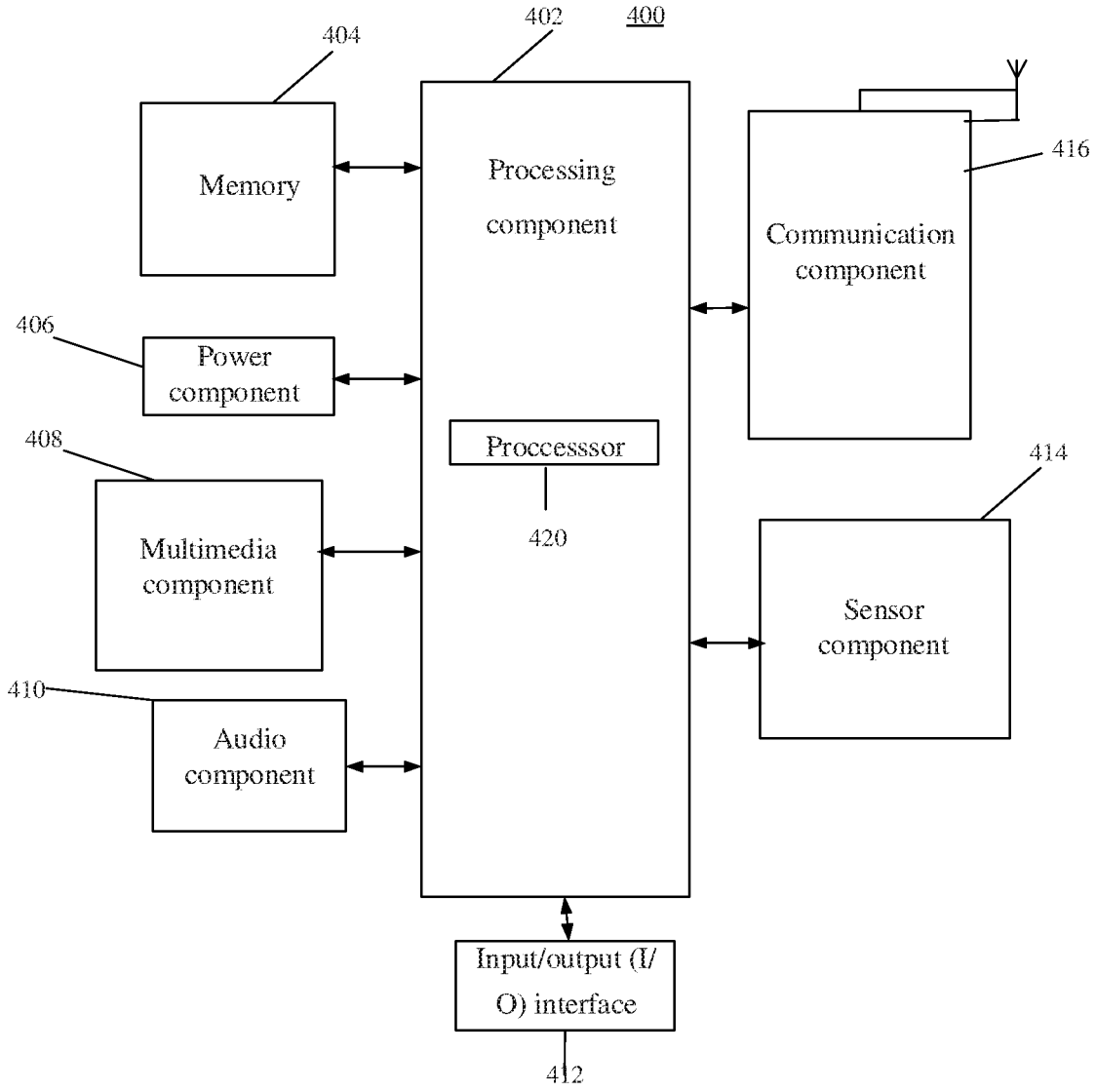
FIG. 4 is a block diagram of a terminal device according to an embodiment of the present disclosure.

FIG. 4 is a block diagram of a terminal device 400 according to an embodiment of the present disclosure. The terminal device 400 may be the above described terminal device, for example, a mobile terminal. Referring to FIG. 4, the terminal device 400 may include one or more of the following components: a processing component 402, a memory 404, a power component 406, a multimedia component 408, an audio component 410, an input/output (I/O) interface 412, a sensor component 414, and a communication component 416.

The processing component 402 typically controls the overall operations of the terminal device 400, such as the operations associated with display, telephone calls, data communications, camera operations, and recording operations. The processing component 402 may include one or more processors 402 to execute instructions to perform all or part of the steps in the above described methods. Moreover, the processing component 402 may include one or more modules which facilitate the interaction between the processing component 402 and other components. For instance, the processing component 402 may include a multimedia module to facilitate the interaction between the multimedia component 408 and the processing component 402.

The memory 404 is configured to store various types of data to support the operation of the terminal device 400. Examples of such data include instructions for any, applications or methods operated on the terminal device 400, contact data, phonebook data, messages, pictures, videos, etc. The memory 404 may be implemented by using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 406 provides power to various components of the terminal device 400. The power component 406 may include a power management system, one or more, power sources, and any other components associated with the generation, management, and distribution of power in the terminal device 400.

The multimedia component 408 includes a screen providing an output interface between the terminal device 400 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense the duration and pressure associated with the touch or swipe action.

In some embodiments, the multimedia component 408 includes a front camera and/or a rear camera. The front camera and/or the rear camera may receive external multimedia data while the terminal device 400 is in an operation mode, such as a photographing mode or a video mode. Each of the front camera and the rear camera may be a fixed optical lens system or have focus and optical zoom capability.

The audio component 410 is configured to output and/or input audio signals. For example, the audio component 410 includes a microphone (MIC) configured to receive external audio signals when the terminal device 400 is in an operation mode, such as a call mode, a recording mode, and a voice recognition mode. The received audio signal may be further stored in the memory 404 or transmitted via the communication component 416. In some embodiments, the audio component 410 further includes a speaker for outputting audio signals.

The I/O interface 412 provides an interface between the processing component 402 and peripheral interface modules, such as a keyboard, a click wheel, buttons, and the like. The buttons may include, but are not limited to, a home button, a volume button, a start button, and a lock button.

The sensor component 414 includes one or more sensors to provide status assessments of various aspects of the terminal device 400. For instance, the sensor component 414 may detect an on/off status of the terminal device 400, relative positioning of components, e.g., the display device and the mini keyboard of the terminal device 400, and the sensor component 414 may also detect a position change of the terminal device 400 or a component of the terminal device 400, presence or absence of user contact with the terminal device 400, orientation or acceleration/deceleration of the terminal device 400, and temperature change of the terminal device 400. The sensor component 414 may include a proximity sensor configured to detect the presence of nearby objects without any physical contact. The sensor component 414 may also include a light sensor, such as a CMOS or CCD image sensor, used for imaging applications. In some embodiments, the sensor component 414 may also include an accelerometer sensor, a gyroscope sensor, a magnetic sensor, a pressure sensor, or a temperature sensor.

The communication component 416 is configured to facilitate communication wirelessly between the terminal device 400 and other devices. In the embodiment of the present disclosure, the communication component 416 can access a wireless network based on a communication standard, such as 20, 30, 40 or 50 or a combination thereof, so as to realize physical downlink control signaling detection. In an exemplary embodiment, the communication component 416 receives broadcast signals or broadcast associated information from an external broadcast management system via a broadcast channel. Optionally, the communication component 416 further includes a near field communication (NFC) module.

In exemplary embodiments, the terminal device 400 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods for detecting ambient light.

In exemplary embodiments, a non-transitory computer-readable storage medium including instructions is also provided, such as the memory 404 including instructions, executable by the processor 420 in the terminal device 400, for performing the above-described methods for detecting ambient light. For example, the non-transitory computer-readable storage medium may be a ROM, a RAM, a CD-ROM, a magnetic tape, a floppy disc, an optical data storage device, and the like.

Other embodiments of the present disclosure will be apparent to those skilled in the art from consideration of the specification and practice of the present disclosure. This application is intended to cover any variations, uses, or adaptations of the present disclosure following the general principles thereof and including common knowledge or commonly used technical measures which are not disclosed herein. It is intended that the embodiments be considered as exemplary only, with a true scope and spirit of the present application being indicated by the appended claims.

It is to be understood that the present disclosure is not limited to the exact construction that has been described above and illustrated in the accompanying drawings, and that various modifications and changes can be made without departing from the scope thereof. The scope of the present disclosure is only defined by the appended claims.

The invention claimed is:

1. A method for detecting ambient light, comprising:

acquiring a detection signal of an ambient light sensor;

acquiring a luminance level of a screen region corresponding to the ambient light sensor; and determining an intensity of the ambient light based on the detection signal of the ambient light sensor and the luminance level of the screen region corresponding to the ambient light sensor, wherein determining the intensity of the ambient light comprises:

when the luminance level is less than a threshold, determining the intensity of the ambient light based on the detection signal of the ambient light sensor; and when the luminance level is greater than or equal to the threshold, determining an interference signal based on the detection signal of the ambient light sensor, and determining the intensity of the ambient light based on the detection signal of the ambient light sensor and the interference signal.

2. The method according to claim 1, wherein acquiring the luminance level of the screen region corresponding to the ambient light sensor comprises:

acquiring a luminance level of each sub-pixel in the screen region corresponding to the ambient light sensor; and determining a sum of the luminance levels of all the sub-pixels in the screen region corresponding to the ambient light sensor as the luminance level of the screen region corresponding to the ambient light sensor.

3. The method according to claim 1, wherein determining the interference signal based on the detection signal of the ambient light sensor comprises:

sampling the detection signal of the ambient light sensor to obtain a sampling signal;

performing Fourier transform for the sampling signal to obtain a first transformation value; and determining the interference signal corresponding to the first transformation value based on a relation between a transformation value and an interference signal.

4. The method according to claim 3, wherein determining the intensity of the ambient light based on the detection signal of the ambient light sensor and the interference signal comprises:

subtracting the interference signal from the sampling signal to obtain a correction signal; and calculating the intensity of the ambient light corresponding to the correction signal.

5. The method according to claim 3, further comprising:

acquiring a plurality of detection signals of the ambient light sensor when the screen displays different luminances in a dark environment;

sampling the plurality of detection signals respectively to obtain a plurality of interference signals;

performing Fourier transform for the plurality of interference signals respectively to obtain a plurality of transformation values; and fitting a relation curve by taking each of the transformation values and the corresponding interference signal as a sampling point to obtain the relation between the transformation value and the interference signal.

6. An apparatus for detecting ambient light, comprising:

a processor; and a memory storing instructions executable by the processor;

wherein the processor is configured to:

acquire a detection signal of an ambient light sensor;

acquire a luminance level of a screen region corresponding to the ambient light sensor; and determine an intensity of the ambient light based on the detection signal of the ambient light sensor and the luminance level of the screen region corresponding to the ambient light sensor, wherein determining the intensity of the ambient light comprises:

when the luminance level is less than a threshold, determining the intensity of the ambient light based on the detection signal of the ambient light sensor; and when the luminance level is greater than or equal to the threshold, determining an interference signal based on the detection signal of the ambient light sensor, and determining the intensity of the ambient light based on the detection signal of the ambient light sensor and the interference signal.

7. The apparatus according to claim 6, wherein the processor is further configured to:

acquire a luminance level of each sub-pixel in the screen region corresponding to the ambient light sensor; and determine a sum of the luminance levels of all the sub-pixels in the screen region corresponding to the ambient light sensor as the luminance level of the screen region corresponding to the ambient light sensor.

8. The apparatus according to claim 6, wherein the processor is further configured to:

sample the detection signal of the ambient light sensor to obtain a sampling signal;

perform Fourier transform for the sampling signal to obtain a first transformation value; and determine the interference signal corresponding to the first transformation value based on a relation between a transformation value and an interference signal.

9. The apparatus according to claim 8, wherein the processor is further configured to:

subtract the interference signal from the sampling signal to obtain a correction signal, and calculate the intensity of the ambient light corresponding to the correction signal.

10. The apparatus according to claim 8, wherein the processor is further configured to:

acquire a plurality of detection signals of the ambient light sensor when the screen displays different luminances in a dark environment;

sample the plurality of detection signals respectively to obtain a plurality of interference signals;

perform Fourier transform for the plurality of interference signals respectively to obtain a plurality of transformation values; and fit a relation curve by taking each of the transformation values and the corresponding interference signal as a sampling point to obtain the relation between the transformation value and the interference signal.

11. The apparatus according to claim 8, being a terminal device.

12. A non-transitory computer-readable storage medium having stored thereon instructions that, when executed by a processor of a device, cause the device to perform a method for detecting ambient light, the method comprising:

acquiring a detection signal of an ambient light sensor;

acquiring a luminance level of a screen region corresponding to the ambient light sensor; and determining an intensity of the ambient light based on the detection signal of the ambient light sensor and the luminance level of the screen region corresponding to the ambient light sensor, wherein determining the intensity of the ambient light comprises:

when the luminance level is less than a threshold, determining the intensity of the ambient light based on the detection signal of the ambient light sensor; and when the luminance level is greater than or equal to the threshold, determining an interference signal based on the detection signal of the ambient light sensor, and determining the intensity of the ambient light based on the detection signal of the ambient light sensor and the interference signal.

13. The non-transitory computer-readable storage medium of claim 12, wherein acquiring the luminance level of the screen region corresponding to the ambient light sensor comprises:

acquiring a luminance level of each sub-pixel in the screen region corresponding to the ambient light sensor; and determining a sum of the luminance levels of all the sub-pixels in the screen region corresponding to the ambient light sensor as the luminance level of the screen region corresponding to the ambient light sensor.

14. The non-transitory computer-readable storage medium of claim 12, wherein determining the interference signal based on the detection signal of the ambient light sensor comprises:

sampling the detection signal of the ambient light sensor to obtain a sampling signal;

performing Fourier transform for the sampling signal to obtain a first transformation value; and determining the interference signal corresponding to the first transformation value based on a relation between a transformation value and an interference signal.

15. The non-transitory computer-readable storage medium of claim 14, wherein determining the intensity of the ambient light based on the detection signal of the ambient light sensor and the interference signal comprises:

subtracting the interference signal from the sampling signal to obtain a correction signal; and calculating the intensity of the ambient light corresponding to the correction signal.

16. The non-transitory computer-readable storage medium of claim 12, further comprising:

acquiring a plurality of detection signals of the ambient light sensor when the screen displays different luminances in a dark environment;

sampling the plurality of detection signals respectively to obtain a plurality of interference signals;

performing Fourier transform for the plurality of interference signals respectively to obtain a plurality of transformation values; and fitting a relation curve by taking each of the transformation values and the corresponding interference signal as a sampling point to obtain the relation between the transformation value and the interference signal.

* * * * *